US011607068B2

(12) United States Patent
Zhu et al.

(10) Patent No.: US 11,607,068 B2
(45) Date of Patent: Mar. 21, 2023

(54) DEFROST SYSTEM FOR SMART LOCKER IN PACKAGE DELIVERY

(71) Applicant: Ford Global Technologies, LLC, Dearborn, MI (US)

(72) Inventors: Ling Zhu, Canton, MI (US); Timothy Feldkamp, Ann Arbor, MI (US); Mitch McConnell, Temperance, MI (US); Sanghyun Hong, Ann Arbor, MI (US); Jianbo Lu, Northvile, MI (US)

(73) Assignee: Ford GLobal Technologies, LLC, Dearborn, MI (US)

( * ) Notice: Subject to any disclaimer, the term of this patent is extended or adjusted under 35 U.S.C. 154(b) by 79 days.

(21) Appl. No.: 17/202,870

(22) Filed: Mar. 16, 2021

(65) Prior Publication Data

US 2022/0296022 A1 Sep. 22, 2022

(51) Int. Cl.
*A47G 29/14* (2006.01)

(52) U.S. Cl.
CPC ..... *A47G 29/141* (2013.01); *A47G 2029/142* (2013.01); *A47G 2029/147* (2013.01); *A47G 2029/149* (2013.01)

(58) Field of Classification Search
None
See application file for complete search history.

(56) References Cited

U.S. PATENT DOCUMENTS 4,615,179 A * 10/1986 Chiu ..... F25D 21/006 62/155
11,365,928 B2 * 6/2022 Ellis ..... F25D 23/04
2016/0286998 A1 10/2016 Lindbo et al.
2019/0277552 A1 9/2019 Vu et al.
2020/0116414 A1 4/2020 Dade et al.

FOREIGN PATENT DOCUMENTS

WO 2015086292 A1 6/2015

OTHER PUBLICATIONS

The Ultimate Guide to Smiota Smart Lockers—(https://smiota.com/)—Feb. 27, 2019.

* cited by examiner

*Primary Examiner* — Carlos Garcia
(74) *Attorney, Agent, or Firm* — Brandon Hicks; Eversheds Sutherland (US) LLP

(57) ABSTRACT

Defrost system for smart locker in package delivery are disclosed herein. An example method can include receiving a delivery message from a delivery unit that a package is to be delivered to a locker unit, the delivery message including an expected delivery time, determining a frozen condition for the locker unit, and activating a defroster element associated with the locker unit before delivery of the package by the delivery unit according to expected delivery time.

20 Claims, 3 Drawing Sheets

DEFROST SYSTEM FOR SMART LOCKER IN PACKAGE DELIVERY

BACKGROUND

For package delivery, a package locker system can be commonly used for residential apartments and/or single house communities in urban areas. In winter, these lockers may become frozen due to the snow and the freezing weather condition. This may cause the units in the lockers to become difficult or even impossible to open. As a result, a customer may not receive their package, and/or a delivery agent may not be able to utilize the locker system and deposit a package.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

The systems and methods disclosed herein are directed to a defrost solution for one or more package lockers under winter and other similar adverse conditions. An example locker system can implement defrost wires to thaw any ice around a door and lock area of a locker unit that receives a package. In some instances, a locker unit in a locker system may have independent wires, which may enable the locker unit to be defrosted individually. The locker system can include a controller configured to execute an automated preheat routine. For example, the controller can receive a signal from a delivery system (such as a drone, a robot, a vehicle, a smart device, etc.) that causes the controller to activate a heating element a predetermined time (e.g., ten minutes or the like) before a delivery robot or delivery vehicle arrives at the locker system. Similarly, a person who receives the package can also request the defrost before pickup. A smart locker network can be used to share information about a frozen condition to other units in the same area.

Illustrative Embodiments

Figure 1:
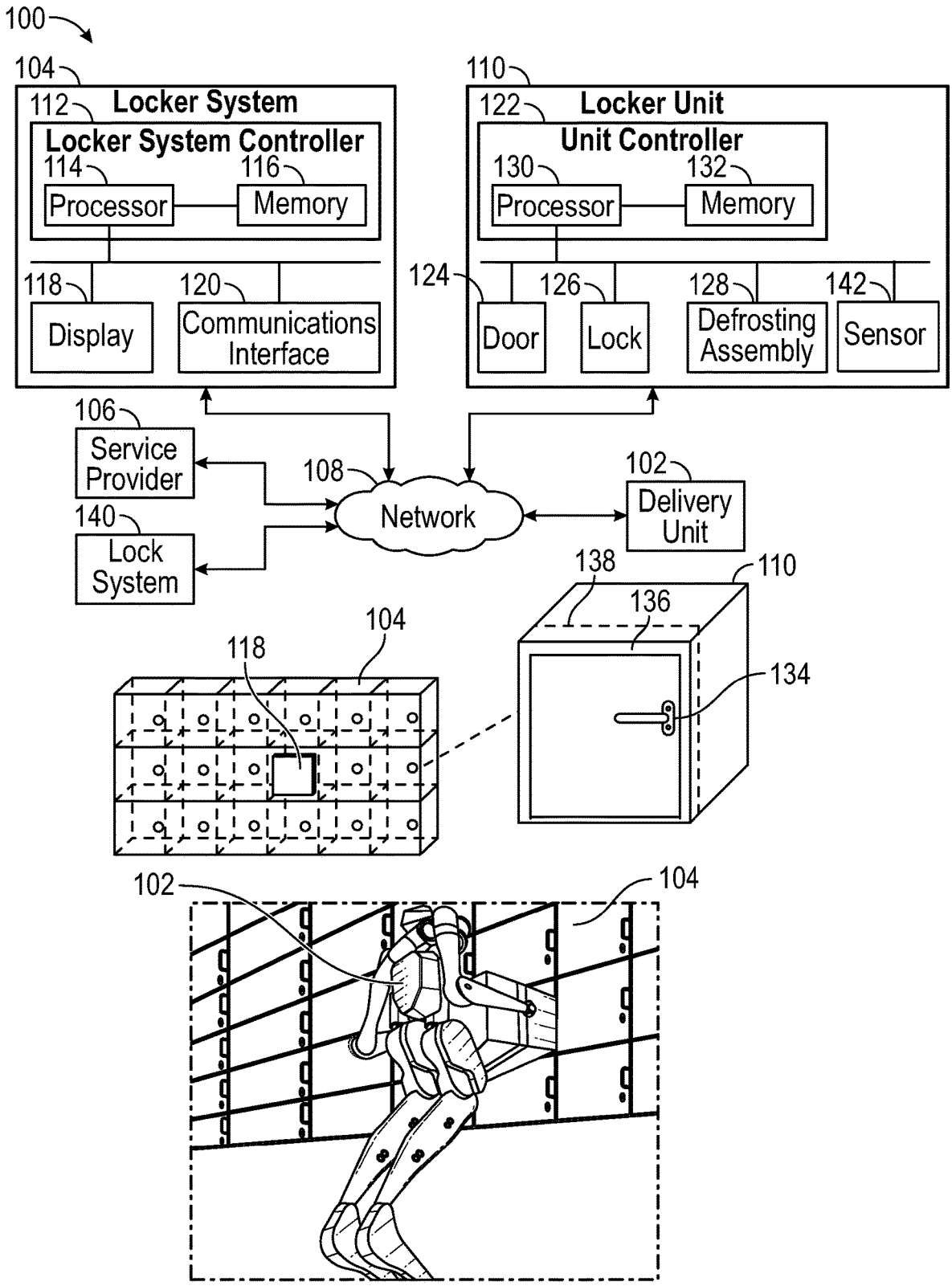
FIG. 1 depicts an illustrative architecture in which techniques and structures for providing the systems and methods disclosed herein may be implemented.

Turning now to the drawings, FIG. 1 depicts an illustrative architecture 100 in which techniques and structures of the present disclosure may be implemented. The architecture 100 can include a delivery unit 102, a locker system 104, a service provider 106, and a network 108. Some or all of these components in the architecture 100 can communicate with one another using the network 108. The network 108 can include combinations of networks that enable the components in the architecture 100 to communicate with one another. The network 108 may include any one or a combination of multiple different types of networks, such as cable networks, the Internet, wireless networks, and other private and/or public networks. In some instances, the network 108 may include cellular, Wi-Fi, or Wi-Fi direct.

The delivery unit 102 can include any delivery device such as a robot or other autonomous vehicle such as an unmanned aerial vehicle. The delivery unit 102 can also include a connected vehicle that is driven by a human. Also, the delivery unit 102 can also include a non-connected vehicle that is driven by a human who is equipped with a smart device, such as a smartphone or tablet. The delivery unit 102 can include a means for communicating over the network 108.

The locker system 104 can comprise one or more locker units, such as locker unit 110. In some instances, the locker system 104 includes a plurality of locker units such as is common in apartment complexes or commercial buildings that service many tenants. The locker system 104 can also comprise a locker system controller 112. The locker system controller 112 can comprise a processor 114, memory 116, an optional display 118, and a communications interface 120 for accessing the network 108. Also, the locker system 104 can be coupled to a power or electrical source to provide electricity to the components of the locker system 104.

In general, the processor 114 executes instructions stored in memory 116 to perform any of the locker maintenance features disclosed herein, such as locker defrosting. It will be understood that when referring to actions performed by the locker system controller 112, this includes the execution of instructions by the processor 114.

Each of the individual locker units, such as locker unit 110, can include a unit controller 122, a door 124, a lock 126, and a defrosting assembly 128. The locker unit 110 is configured to receive and retain a package and can have any defined size. The door 124 can be actuated to allow for opening and closing. For example, the door 124 may be attached via a hinge or the like. The lock 126 can secure the door 124. In some instances, the lock 126 can be manually actuated using a key. Alternatively, the lock 126 can include a smart-lock that can be actuated electronically.

In general, the unit controller 122 can comprise a processor 130 that executes instructions stored in memory 132 to perform any of the locker maintenance features disclosed herein, such as locker defrosting. It will be understood that when referring to actions performed by the unit controller 122, this includes the execution of instructions by the processor 130. In some instances, the unit controller 122 may not be present.

The defrosting assembly 128 can include a first defrosting element 134 that is associated with the door 124 and a second defrosting element 136 that is associated with the lock 126. For example, the first defrosting element 134 can include a defrosting wire that heats when an electrical current is applied by the unit controller 122. The first defrosting element 134 can extend around a peripheral edge of the door 124. The second defrosting element 136 can also include a defrosting wire that encircles the lock 126. In some instances, a third defrosting element 138 can extend around an outer-peripheral geometry of the locker unit 110. Thus, the interfacing surfaces or edges of the locker unit 110 and the door 124 can be independently heated.

Referring back to the locker system controller 112, the locker system controller 112 can be configured to orchestrate operations of the individual locker units. For example, the locker system controller 112 can communicate with the service provider 106 to obtain weather related information. This can include ambient weather information for a region that includes the locker system 104.

The locker system controller 112 can receive weather information from the service provider 106 and perform predictive analytics on the same to determine when a frozen condition may be present with respect to the locker units. The frozen condition can indicate that the locker unit is likely to be in a frozen condition or that ambient weather conditions around the locker system have increased a likelihood that the locker unit is frozen.

In one example, assume that the weather information is indicative of a recent snow or ice storm. Also, subsequent to the storm the weather information indicates that the temperature around the locker system 104 may reach melting temperature. This may result in the snow melting and water may leak into and/or around the locker units. If the temperature drops below freezing in the evening, at night, or early morning, the locker units may freeze if water is present. In these instances, the locker system controller 112 can detect that water is likely to be present and may freeze. Thus, the locker system controller 112 can automatically defrost a locker unit when the locker system controller 112 receives an indication from the delivery unit 102 that a package is being delivered within a specified period of time. For example, the delivery unit 102 may transmit a signal to the locker system controller 112 that indicates that the delivery unit 102 may be delivering a package to a locker unit within a specified time frame, such as ten minutes. Upon receiving this signal, the locker system controller 112 can pre-defrost the locker unit before delivery unit 102 arrival.

For example, the locker system controller 112 may learn over time that many tenants pick up their mail after 5 pm, the locker system controller 112 can choose to defrost all units at a time before 5 pm. The specified time frame can vary according to locker design. The locker system controller 112 can be configured to learn and adapt to the behavior of how individual locker units are used and utilize this type of historical data to select when locker units may be defrosted.

In another example, the locker system controller 112 may choose to defrost all or a portion of the units based only on the prediction and/or detection of ice. Also, during a potential water condition such as rain or freezing rain, the locker system controller 112 may determine when the ambient temperature has dropped below freezing and that water is likely present. The locker system controller 112 may detect an actual or potential frozen condition and execute locker unit defrosting in response. The locker system controller 112 may also sense or predict a potential water condition where evaporating condensation can be estimated based on detection ambient temperature and measurement time. In sum, the locker system controller 112 can infer or predict a frozen condition of a locker unit based on a weather pattern. A weather pattern may be determined from past, current, and/or future weather conditions. Thus, one example pattern includes determining snow or ice conditions followed by thawing conditions, which are followed by freezing temperatures. Another example includes evaporative conditions followed by freezing temperatures. Generally, any conditions that may lead to exposure of a locker unit to liquid water followed by freezing temperatures may trigger an inference that the locker unit is frozen. In some instances, the locker unit 104 can include a moisture sensor 142 that detects presence of moisture inside or on a surface of the locker unit 104.

In yet another example, a user of the locker system 104 can utilize the display 118 to defrost an individual locker unit if the locker unit is frozen. That is, the display 118 can function as a human-machine interface. The user can interact with the locker system 104 using graphical user interfaces presented on the display 118. Further, if a user selects to have a locker unit defrosted, the locker system controller 112 can be configured to execute a defrosting of other locker units positioned around the identified locker unit, or in some instances all locker units. The user can also use their smart device, such as a Smartphone to transmit information to the locker system controller 112. For example, a user can transmit a signal to the locker system controller 112 that indicates that their locker unit is frozen. Additionally, a delivery unit such as a drone or robot can also transmit a similar signal to the locker system controller 112 if the drone or robot attempts to open the locker unit and it appears to be in a frozen condition.

It will be understood that while the prior examples involved the use of the locker system controller 112 to orchestrate defrosting features for individual locker units, each of the locker units can be individually configured to provide the same functions independently from one another. In some instances, when the locker system controller 112 detects or predicts a frozen condition, the locker system controller 112 can transmit this frozen condition to other smart lockers or the service provider 106. For example, the locker system controller 112 can transmit a frozen condition signal to another locker system 140 located remotely. The locker system controller 112 can also route the frozen condition signal to the locker system 140 through the service provider 106.

Figure 2:
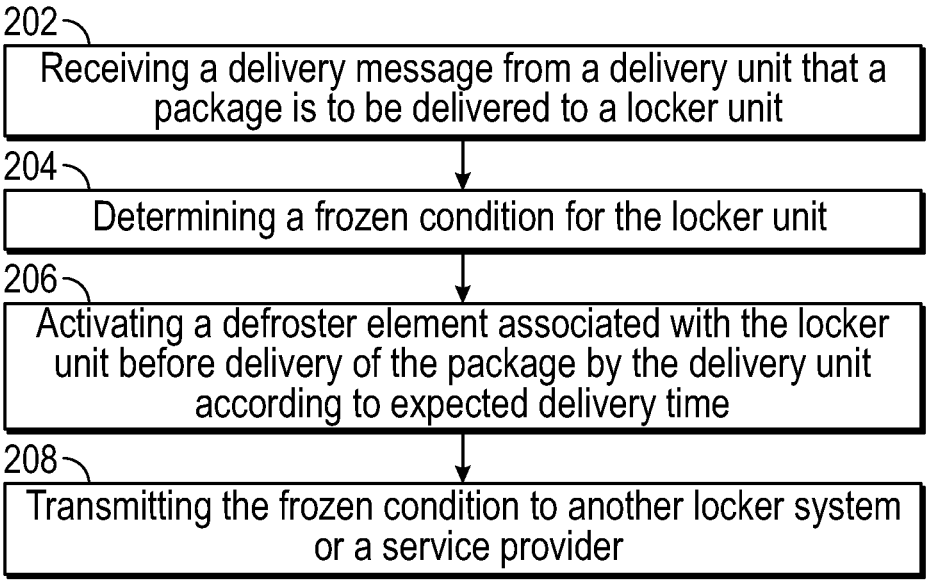
FIG. 2 is a flowchart of an example method of the present disclosure.

FIG. 2 is a flowchart of an example method of the present disclosure. The method can include a step 202 of receiving a delivery message from a delivery unit that a package is to be delivered to a locker unit. The delivery message can include an expected delivery time or estimated time of arrival for the delivery unit at the locker system.

Next, the method can include a step 204 of determining a frozen condition for the locker unit. The frozen condition can be determined or inferred in various ways. For example, a unit controller (of an individual locker unit) or a locker system controller (a system with a plurality of locker units) can receive an indication that the locker unit is frozen from a human-machine interface associated with the locker unit. In another example, the frozen condition can be determined using weather information. An example method of determining a frozen condition from weather information is provided in FIG. 3.

The method can also include a step 206 of activating a defroster element associated with the locker unit before delivery of the package by the delivery unit according to expected delivery time. To be sure, in some instances, step 204 may be eliminated. That is, the step of activating a defroster element can be based only on receiving the message from the delivery unit that a package is about to be delivered. As noted above, the message can indicate that an estimated time of delivery is within fifteen minutes. The controller can activate the defroster of the locker unit when the message is received or within another predetermined period of time. For example, the controller can activate the defroster when it is within ten minutes of the estimated time of delivery. To be sure, other time frames can be used and may be based on design requirements, such as how long it may take to defrost the door and/or a lock of the locker unit.

In some instances, the method can include a step 208 of transmitting the frozen condition to another locker system or a service provider. Thus, a frozen condition of a locker system can be relayed to other locker systems that may or may not have weather analysis capabilities. Also, the control capabilities of the locker system can be decentralized and maintained within a cloud environment or another on-premise computing system. For example, in an apartment complex, some functionalities can be managed from a server. The server can analyze weather data and/or package delivery messages and disseminate defrost requests to locker systems and/or individual locker units.

Figure 3:
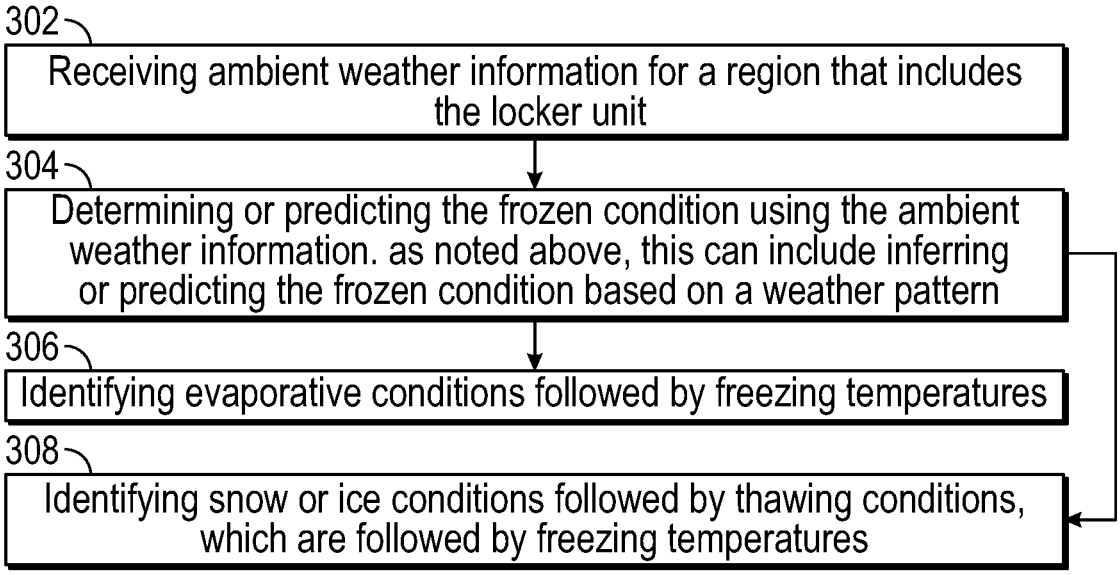
FIG. 3 is a flowchart of another example method of the present disclosure.

FIG. 3 is another example method related to processing and utilizing weather information. The method can include a step 302 of receiving ambient weather information for a region that includes the locker unit. This ambient weather information can be received from a third-party weather service over a network connection by a controller of a locker system or locker unit. The method can include a step 304 of determining or predicting the frozen condition using the ambient weather information. As noted above, this can include inferring or predicting the frozen condition based on a weather pattern. An example weather pattern in step 306 includes identifying evaporative conditions followed by freezing temperatures. Another example weather pattern in step 308 includes snow or ice conditions followed by thawing conditions, which are followed by freezing temperatures.

Figure 4:
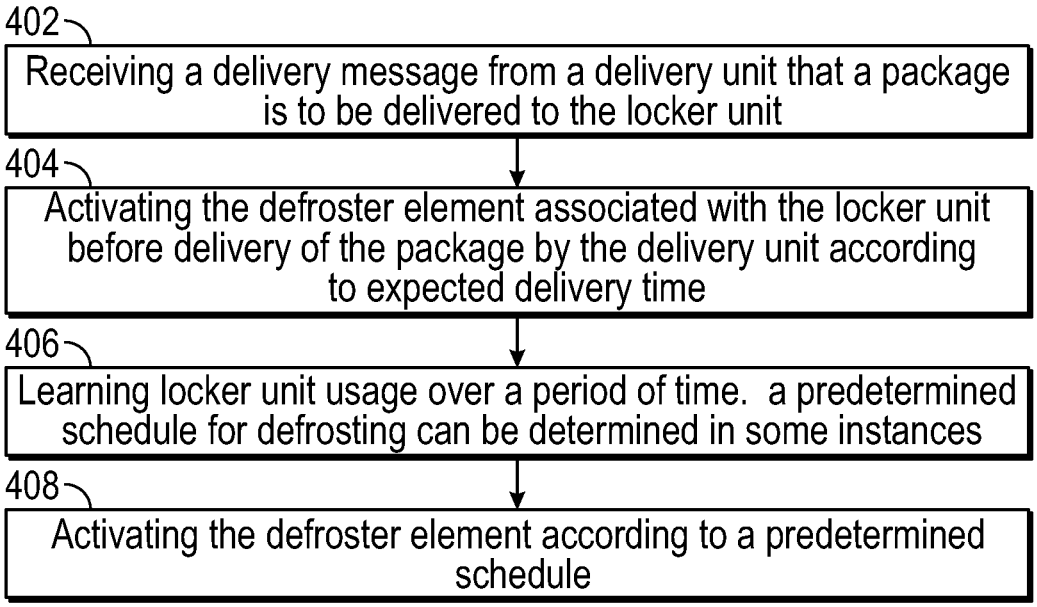
FIG. 4 is a flowchart of yet another example method of the present disclosure.

FIG. 4 is another example method of the present disclosure. The method can include a step 402 of receiving a delivery message from a delivery unit that a package is to be delivered to the locker unit. As noted, the delivery message can comprise an expected delivery time. In some instance, the method can include a step 404 of activating the defroster element associated with the locker unit before delivery of the package by the delivery unit according to expected delivery time. The method may also include a step 406 of learning locker unit usage over a period of time. A predetermined schedule for defrosting can be determined in other instances. For example, it may be determined that a user access a particular locker unit at 3 pm every weekday. The method can include a step 408 of activating the defroster element according to a predetermined schedule.

Implementations of the systems, apparatuses, devices, and methods disclosed herein may comprise or utilize a special purpose or general-purpose computer including computer hardware, such as, for example, one or more processors and system memory, as discussed herein. Computer-executable instructions comprise, for example, instructions and data which, when executed at a processor, cause a general-purpose computer, special purpose computer, or special purpose processing device to perform a certain function or group of functions. An implementation of the devices, systems, and methods disclosed herein may communicate over a computer network. A "network" is defined as one or more data links that enable the transport of electronic data between computer systems and/or modules and/or other electronic devices.

Further, it should be noted that any or all of the aforementioned alternate implementations may be used in any combination desired to form additional hybrid implementations of the present disclosure. For example, any of the functionality described with respect to a particular device or component may be performed by another device or component. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described exemplary embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching.

What is claimed is:

1. A method comprising:

determining an expected delivery time of a package to a locker unit;

determining an expected retrieval time of the package from the locker unit, wherein the expected retrieval time is based on usage of the locker unit over time;

determining a condition of the locker unit; and activating, based on the condition of the locker unit and the expected delivery time or expected retrieval time, a defroster element associated with the locker unit before delivery of the package, wherein the defroster element is configured to melt ice around a peripheral edge of a door of the locker unit and around a lock of the locker unit.

2. The method according to claim 1, further comprising:

receiving ambient weather information around the locker unit; and determining, based on the ambient weather information, the condition of the locker unit.

3. The method according to claim 1, wherein determining the condition of the locker unit comprises receiving, from a human-machine interface associated with the locker unit, an indication that the locker unit is frozen.

4. The method according to claim 1, further comprising transmitting the condition of the locker unit to another locker system or a service provider.

5. The method according to claim 1, wherein determining the condition of the locker unit comprises inferring or predicting the condition of the locker unit based on a weather pattern.

6. The method according to claim 5, wherein the weather pattern includes evaporative conditions followed by freezing temperatures.

7. The method according to claim 5, wherein the weather pattern includes snow or ice conditions followed by thawing conditions, which are followed by freezing temperatures.

8. The method according to claim 1, further comprising activating the defroster element according to a predetermined schedule.

9. A system comprising:

a locker unit having a door and a lock;

a defroster element associated with the door and/or the lock;

a unit controller comprising a processor and memory, the processor executing instructions stored in the memory to:

determine an expected delivery time of a package to the locker unit;

determine an expected retrieval time of the package from the locker unit based on usage of the locker unit over time; and activate, based on the expected delivery time or the expected retrieval time, the defroster element before delivery or retrieval of the package.

10. The system according to claim 9, further comprising another defroster element associated with a housing of the locker unit.

11. The system according to claim 9, wherein the unit controller activates the defroster element based on a signal received from a locker system controller.

12. The system according to claim 9, further comprising a human-machine interface that includes a display screen, the human-machine interface being configured to receive input from a user that indicates that the locker unit is in a frozen condition.

13. The system according to claim 9, wherein the processor is configured to:

receive ambient weather information around the locker unit; and determine, based on the ambient weather information, a condition of the locker unit.

14. The system according to claim 9, wherein the defroster element includes a defrosting wire that encircles the door and/or the lock.

15. The system according to claim 9, wherein the processor is configured to determine a condition for the locker unit by determining:

evaporative conditions followed by freezing temperatures; and/or snow or ice conditions followed by thawing conditions, which are followed by freezing temperatures.

16. A locker system comprising:

a plurality of locker units, wherein each locker unit of the plurality of locker units comprise a door and a lock;

a first defroster element associated with the doors of at least some of the plurality of locker units;

a second defroster element associated with the locks of at least some of the plurality of locker units; and a locker system controller having a processor, the processor executing instructions stored in memory to:

determine a condition for at least some of the plurality of locker units;

determine an expected use time of the locker unit based on usage of the locker unit over time; and activate, based on the condition and the expected use time, the first defroster element and/or the second defroster element.

17. The locker system according to claim 16, wherein the processor is configured to receive an indication that one of the plurality of locker units is frozen from a delivery unit or a smart device that communicates with the locker system.

18. The locker system according to claim 16, wherein the processor is configured to infer the condition based on a weather pattern.

19. The locker system according to claim 18, wherein the weather pattern includes evaporative conditions followed by freezing temperatures.

20. The locker system according to claim 18, wherein the weather pattern includes snow or ice conditions followed by thawing conditions, which are followed by freezing temperatures.

* * * * *